United States Patent [19]

Hagedorn et al.

[11] Patent Number: 4,485,515

[45] Date of Patent: Dec. 4, 1984

[54] CLEANING BRUSH

[76] Inventors: Leonhard Hagedorn, Lohrheimer Strasse 10, D-6251 Niederneisen; Rolf-Günter Schülein, Gartenstrasse 13, D-5409 Singhofen, both of Fed. Rep. of Germany

[21] Appl. No.: 375,133

[22] PCT Filed: Aug. 6, 1981

[86] PCT No.: PCT/DE81/00119

§ 371 Date: Apr. 8, 1982

§ 102(e) Date: Apr. 8, 1982

[87] PCT Pub. No.: WO82/00577

PCT Pub. Date: Mar. 4, 1982

[30] Foreign Application Priority Data

Aug. 12, 1980 [DE] Fed. Rep. of Germany ..... 3030394

[51] Int. Cl.[3] ..... A46B 17/04

[52] U.S. Cl. ..... 15/184; 15/104 A; 15/231

[58] Field of Search ..... 15/184, 202, 203, 104 A, 15/209 R, 209 E, 231; 132/85

[56] References Cited

U.S. PATENT DOCUMENTS

| | | | |
|---|---|---|---|
| 2,051,009 | 8/1936 | Porter | 15/184 |
| 2,695,416 | 11/1954 | Raimo | 15/184 X |
| 3,800,353 | 4/1974 | Roth | 15/184 |
| 4,062,083 | 12/1977 | McKay | 15/184 X |

FOREIGN PATENT DOCUMENTS

| | | | |
|---|---|---|---|
| 470872 | 5/1969 | Switzerland | 15/104 A |

*Primary Examiner*—Peter Feldman

*Attorney, Agent, or Firm*—John T. O'Halloran; Peter R. Ruzek; Mary C. Werner

[57] ABSTRACT

A cleaning brush for brushing clothing has a slip case that circumferentially surrounds a passage having a brush therein. The slip case has open ends, the brush being slid into and out of the slip case through either end. The slip case acts as a handle. Stops are provided at each of the open ends to prevent the brush from being separated from the slip case.

11 Claims, 5 Drawing Figures

CLEANING BRUSH

Figure 1:
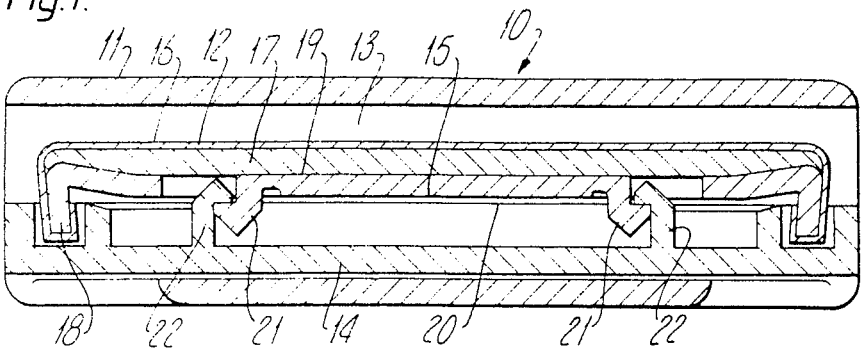

The invention relates to a cleaning brush, especially for articles of clothing, with brush elements which are located on a supporting body, with elastic padding materials interposed. The hitherto known forms of construction of this type have the disadvantage that, when the cleaning brush is not in use, the brush elements become dirty, because they lie unprotected in the open. To remedy this, pouch-like receptacles made of plastic film have already been developed, and the cleaning brushes are accommodated in these, when not in use. Even this treatment has proved unsuccessful, especially as the pouch-like receptacles are easily torn or lost.

The object on which the invention is based is, while avoiding the defects mentioned, to provide a cleaning brush of the generic type, in which the brush elements are protected from becoming dirty, when the cleaning brush is not in use. To achieve this object, it is proposed, according to the invention, that the brush-element supporting body be received displaceably by a tubular slipcase open at both ends. Is is ensured, by means of this design, that the brush elements are located within the slipcase when the cleaning brush is not in use.

In a preferred embodiment, the brush-element supporting body can have a carriage-like receiving part, which can move to and fro on guide tracks provided on the bottom of the inner space of the slipcase. This has the advantage that the brush-element supporting body can be transferred into a working position, when the cleaning brush is in use, and into a position of rest, when it is not in use.

According to a further feature of the invention, there can be moulded on the carriage-like receiving part, on its two longitudinal sides, projecting strips which interact with stop strips provided on the two side walls of the inner space of the slipcase. The result of this is that the sliding movements of the receiving part in the inner space of the slipcase are controlled.

The carriage-like receiving part can be capable of being pulled out of the slipcase in both directions up to limiting stops which are provided, at opposite ends, on the side walls of the inner space of the slipcase. This has the advantage that the receiving part cannot be pulled out of the slipcase completely.

The carriage-like receiving part can have, underneath the projecting strips, groove-like recesses, which can extend, in certain regions, over the two side walls of the receiving part and be limited at one end by stop buffers located at opposite ends of the side walls.

There can be provided in one groove-like recess, in the vicinity of its free end, a wart-like protrusion, which guarantees easy sliding of the receiving part in the slipcase, even in the case of relatively large production tolerances.

Advantageously, the brush-element supporting body has a filling plate which is fitted with a wide rim and which consists of a square-section basic body, the surface of which extends in the form of a funnel, whilst moulded on the inner face of the basic body are holding claws which have roof-shaped heads and which engage behind counter-claws seated on the inner side of the receiving part.

Expediently, the rim of the filling plate is received by a square-section channel which is set into the inner side of the receiving part.

To enable the carriage-like receiving part to be grasped properly, the slipcase is expediently equipped with recesses on the end faces of its bottom plate. The slipcase, receiving part and filling plate preferably consist of one-piece plastic moulded bodies.

Figure 2:
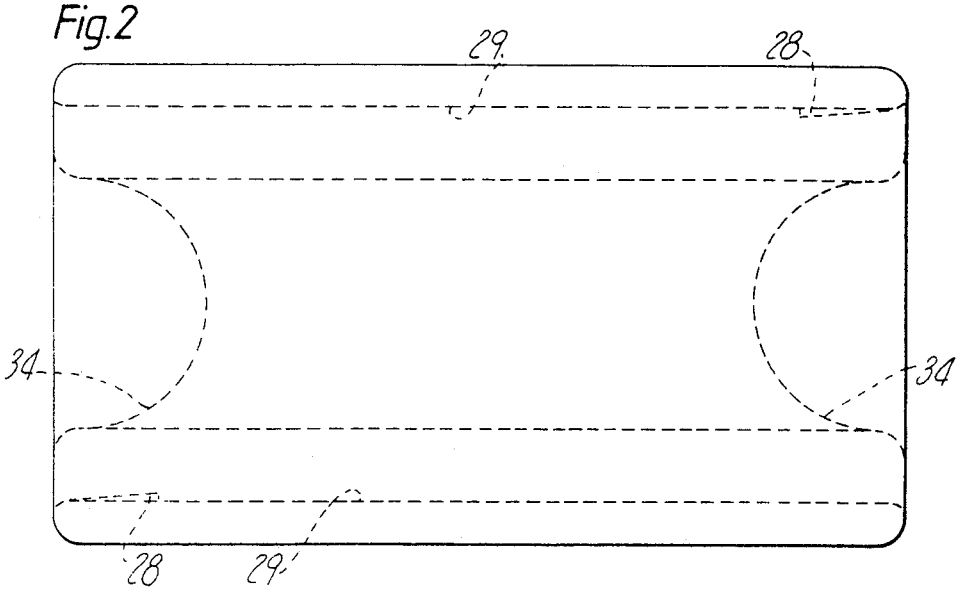
Figure 3:
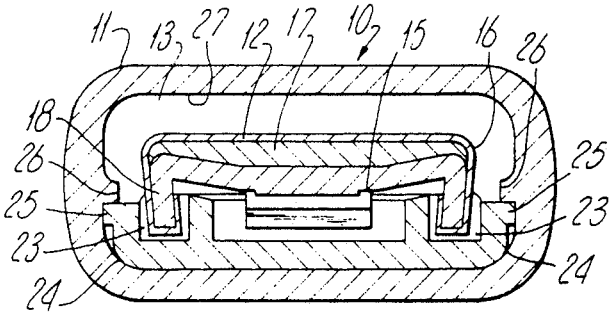
Figure 4:
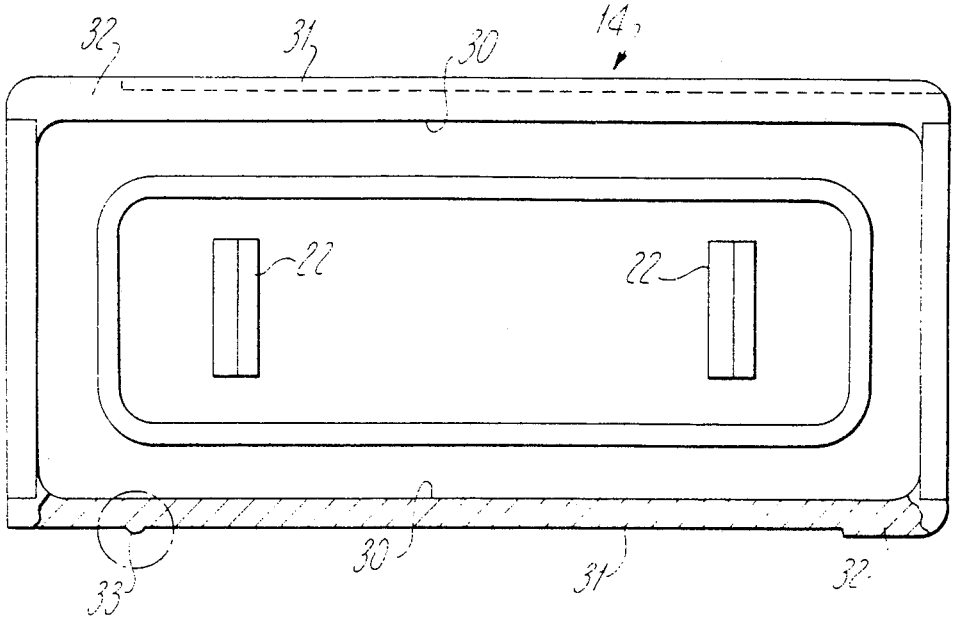
Figure 5:
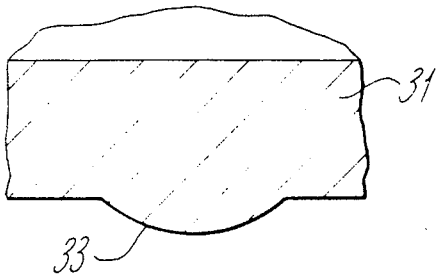

The invention is illustrated, in a exemplary embodiment, in the drawing in which:

FIG. 1 shows a longitudinal section through the cleaning brush pushed into its slipcase, FIG. 2 shows a plan view of the slipcase, FIG. 3 shows a cross-section through the cleaning brush pushed into its slipcase, FIG. 4 shows a plan view of the receiving part, partly in cross-section, and FIG. 5 shows an enlargement of the place in FIG. 4 identified by a circle.

The cleaning brush 10, on which the exemplary embodiment is based, consists, as illustrated in FIGS. 1 and 3, of a slipcase 11 made of plastic and of a brush-element supporting body 12 mounted displaceably in the latter. The cassette 11 is made tubular, so that an inner space 13 accessible from the two end faces of the cassette is obtained.

The brush-element supporting body 12 is composed of a carriage-like receiving body 14 and of a filling plate 15.

The brush elements 16 consist of a fabric into which the individual bristles are introduced. It is a blank of material made of brush velours. The brush element 16 is fastened to the filling plate 15, with elastic padding material 17 interposed. To make this possible, the filling plate 15 is equipped with a wide rim 18. The padding material 17 consisting of a blank of foam material lies on the funnel-shaped surface 19 of the filling plate 15. As is evident from FIGS. 1 and 3, the edges of the brush element 16 are wrapped round the rim 18 of the filling plate 15 and glued firmly there.

The filling plate 15 consists of a square-section basic body 20, on the inner face of which are moulded holding claws 21 having roof-shaped heads. In their effective position, the holding claws 21 engage behind counter-claws 22 located on the inner side of the receiving part 14. As a result, the filling plate 15 is connected unreleasably to the receiving part 14. The rim 18 of the filling plate 15 is received by a square-section channel 23 which is set into the inner side of the receiving part 14.

The receiving part 14 is designed as a carriage and can be moved to and fro on guide tracks 24 provided on the bottom of the inner space 13 of the slipcase. The carriage-like receiving part 14 is equipped on its two longitudinal sides with projecting strips 25 which interact with stop strips 26 crossing the two side walls 29 of the inner space 13 of the slipcase approximately in the middle. The projecting strips 25, together with the stop strips 26, make it possible to move the brush-element supporting body 12 towards the top surface 27 of the slipcase 11.

The carriage-like receiving part 14 can be pulled out of the cassette 11 in both directions, until limiting stops 28, which, as FIG. 2 shows, are provided, at opposite ends, on the side walls 29 of the inner space 13 of the slipcase, limit the movement.

The limiting stops 28 are of wedge-shaped design. To ensure that they permit the sliding movement of the carriage-like receiving part 14 in the desired regions, groove-like recesses 31, which are limited at one end by stop buffers 32, are moulded, in certain regions, into the two side walls 30 of the receiving part.

As is evident from FIG. 5, there is provided in one groove-like recess 31, in the vicinity of its free end, a wart-like protrusion 33, which serves to guarantee easy sliding in the slipcase, even in the case of relatively large production tolerances.

When the carriage-like receiving part 14 is introduced into the inner space 13 of the cassette 11, one stop buffer 32 slides along on the wedge-shaped face of the limiting stop 28, until the limiting stop 28 is located in one groove-like recess 31. To enable the receiving part 14 to be grasped easily, semicircular recesses 34 are made in the slipcase bottom, as shown in FIG. 2.

As already mentioned, the embodiment illustrated is only one example of putting the invention into practice. The invention is not restricted to this. Many other modifications and applications are possible. Thus, the projecting strips 25 could also interact with channel-like depressions, which are made in the side walls 29 of the slipcase 11.

We claim:

1. A cleaning brush for brushing clothing comprising:

a brush means;

means for circumferentially bounding an elongated passage at least partially receiving said brush means and having longitudinally spaced open ends to allow said brush means to be slid into and out of said bounding means through either one of said open ends thereof for the bounding means to serve as a handle for said brush means during a brushing operation; and means for limiting the extent of movement of said brush means out of either one of said open ends to prevent the brush means from being separated from said bounding means.

2. The cleaning brush as in claim 1, wherein said brush means includes a bristle portion and a supporting element on which said bristle portion is mounted.

3. The cleaning brush as in claim 2, wherein said limiting means includes stop elements projecting from said supporting element and moving in respective paths during the sliding movement of said brush means, and limiting stops positioned in said bounding means and extending into the respective paths to constitute abutments for said limiting stops.

4. The cleaning brush as in claim 3, wherein said stop elements are positioned on the outer longitudinal surfaces of said supporting element and said limiting stops are positioned on the inner surface and at opposite ends of said bounding means.

5. The brush as claimed in claim 1, wherein said bounding means includes guide tracks positioned on the inner surface thereof for guiding said supporting element during the sliding movement thereof.

6. The brush as claimed in claim 2, wherein said supporting element includes means for reducing the friction between said supporting element and said bounding means during sliding movement.

7. The brush as claimed in claim 6, wherein said friction reducing means includes at least one wart-like projection located on the respective elongated side of the supporting element at the end opposite said stop elements.

8. The brush as claimed in claim 2, wherein said brush means further includes means for mounting said bristle portion to said supporting element, said mounting means including hook-shaped projections extending from a longitudinal surface of said supporting element and a plate positioned intermediate said bristle portion and said longitudinal surface and including hook-shaped projections extending from a longitudinal surface of said plate toward said receiving element to engage the projections of said supporting element.

9. The brush as claimed in claim 1, wherein said bounding means has recesses on the ends thereof to permit access to the respective end portions of said brush means for sliding the latter into and out of said open ends of said bounding means.

10. The brush as claimed in claim 1, wherein said bounding means circumferentially completely surrounds said passage.

11. The brush as claimed in claim 8, wherein said bounding means, said supporting element and said plate are each of a synthetic plastic material.

* * * * *